US009049759B2

(12) United States Patent
Tikkanen et al.

(10) Patent No.: US 9,049,759 B2
(45) **Date of Patent: *Jun. 2, 2015**

(54) CONFIGURABLE LED DRIVER/DIMMER FOR SOLID STATE LIGHTING APPLICATIONS

(71) Applicant: Lumastream Canada ULC, Calgary (CA)

(72) Inventors: David Tikkanen, Waterloo (CA); Jason Neudorf, Kitchener (CA); Steven Lyons, Kitchener (CA); Kyle Grahame Hathaway, Kitchener (CA)

(73) Assignee: Lumastream Canada ULC, Calgary (CA)

( * ) Notice: Subject to any disclaimer, the term of this patent is extended or adjusted under 35 U.S.C. 154(b) by 131 days.

This patent is subject to a terminal disclaimer.

(21) Appl. No.: 13/941,871

(22) Filed: Jul. 15, 2013

(65) Prior Publication Data

US 2013/0300312 A1 Nov. 14, 2013

Related U.S. Application Data

(63) Continuation of application No. 13/059,336, filed as application No. PCT/CA2009/001295 on Sep. 17, 2009, now Pat. No. 8,525,446.

(60) Provisional application No. 61/097,963, filed on Sep. 18, 2008.

(51) Int. Cl.
*H05B 37/00* (2006.01)
*H05B 33/08* (2006.01)

(52) U.S. Cl.
CPC ..... *H05B 33/0806* (2013.01); *H05B 33/0815* (2013.01); *H05B 33/0896* (2013.01)

(58) Field of Classification Search
CPC ..... H02B 33/0815; H02B 41/28; H02B 33/0803; H02B 33/0806
USPC ..... 315/247, 291, 294, 297, 302, 307, 312
See application file for complete search history.

(56) References Cited

U.S. PATENT DOCUMENTS 5,008,595 A 4/1991 Kazar
5,420,780 A 5/1995 Bernstein et al.

(Continued)

FOREIGN PATENT DOCUMENTS

WO 2008052293 5/2008
WO 2009039112 3/2009

OTHER PUBLICATIONS

Ericsson AB, Power Supplies Goes Digital White Paper, Oct. 2006.

(Continued)

*Primary Examiner* — Jason M Crawford
(74) *Attorney, Agent, or Firm* — Gowling Lafleur Henderson LLP; Jeffrey W. Wong

(57) ABSTRACT

A configurable light emitting diode (LED) driver for powering a set of light fixture loads comprising a power circuit which includes an inrush current limit and a DC/DC convertor, a power factor correction (PFC) boost connected to the inrush current limit and the DC/DC converter, a regulated output voltage bus connected to the DC/DC converter, and a primary digital controller for controlling the power circuit. The driver further includes a set of output current drivers, each of the set of output current drivers connected to one of the set of light fixture loads for powering the associated light fixture load. The driver also includes an apparatus for configuring the set of output current drivers to an output current set point and at least one power limit connected to the regulated output voltage bus.

25 Claims, 12 Drawing Sheets

(56) References Cited

U.S. PATENT DOCUMENTS

| | | | | |
|---|---|---|---|---|
| 6,720,745 | B2 | 4/2004 | Lys et al. | |
| 7,310,074 | B2 | 12/2007 | Chen | |
| 7,405,523 | B2 | 7/2008 | Wilhelm et al. | |
| 7,804,189 | B2 | 9/2010 | Koehler et al. | |
| 7,961,113 | B2 | 6/2011 | Rabiner et al. | |
| 8,143,792 | B2 | 3/2012 | Joo et al. | |
| 8,197,079 | B2 | 6/2012 | Ruud et al. | |
| 8,258,721 | B2 | 9/2012 | Meyer | |
| 8,310,171 | B2 | 11/2012 | Reisenauer et al. | |
| 8,436,555 | B2 | 5/2013 | Lo et al. | |
| 8,525,446 | B2 * | 9/2013 | Tikkanen et al. | 315/312 |
| 8,604,712 | B2 | 12/2013 | Bloom et al. | |
| 2002/0047642 | A1 * | 4/2002 | Miyagawa | 315/307 |
| 2005/0218838 | A1 * | 10/2005 | Lys | 315/291 |
| 2005/0289279 | A1 | 12/2005 | Fails et al. | |
| 2006/0132063 | A1 | 6/2006 | Hung et al. | |
| 2008/0018261 | A1 * | 1/2008 | Kastner | 315/192 |
| 2008/0025028 | A1 * | 1/2008 | Gloisten et al. | 362/294 |
| 2009/0179594 | A1 | 7/2009 | Yang | |
| 2010/0066267 | A1 | 3/2010 | Meyer | |
| 2010/0164403 | A1 * | 7/2010 | Liu | 315/297 |
| 2010/0231136 | A1 | 9/2010 | Reisenauer et al. | |
| 2011/0018464 | A1 | 1/2011 | Lo et al. | |
| 2011/0309746 | A1 | 12/2011 | Eckel et al. | |

OTHER PUBLICATIONS

Skanda; Microchip Technology Inc., Power Factor Correction in Power Conversion Applications using the dsPIC® DSC, AN1106, Jun. 2007.

Traxon Technologies, LED Engine XB 3W-108 Technical Specifications and User Manual Version 1.1, 2007.

Penwell Corporation, Dialight Lumidrives Launches Colurdriver XP for High-Power LEDs, LEDs Magazine, downloaded from http://www.ledsmagazine.com/press/15469, Sep. 25, 2007.

US-Tech Online, Dialight: New High Power LED Driver, downloaded from http://www.us-tech.com, Oct. 2007.

IST Ltd., iDrive™ 1000 The Intelligent 210W LED Driver User Manual, v. 1.7, Jun. 20, 2008.

Roal Electronics, S.P.A, Programmable RGB LED Driver 200 Watts Model RHPS180 Product Details, Rev. 2, Oct. 2007.

International Searching Authority (CA), International Search Report and Written Opinion for International Patent Application No. PCT/CA2009/001295, Jan. 13, 2010.

Search & Examination Report (UK), Further Search Report and Examination Report for GB1102782.8, Sep. 6, 2012.

United States Patent and Trademark Office, Office Action for U.S. Appl. No. 13/059,336, Jan. 23, 2013.

Colourdriver XP data sheet, Jul. 30, 2008.

Tryka L.E.D. Ltd, Product Information Sheet for IDS-12 Intelligent Drive System, http://www.tryka.co.uk/IDS-12.htm, downloaded Jul. 18, 2007.

United States Patent and Trademark Office, Office Action for U.S. Appl. No. 13/466,529, Dec. 13, 2013.

United States Patent and Trademark Office, Office Action for U.S. Appl. No. 13/466,509, Feb. 21, 2014.

United States Patent and Trademark Office, Office Action for U.S. Appl. No. 13/466,509, Jun. 27, 2014.

United States Patent and Trademark Office, Notice of Allowance for U.S. Appl. No. 13/466,509, Oct. 6, 2014.

Power Vector (A Division of Electronic Craftsmen), Product Information Sheet for IRIS LED Driver/Dimmer, Oct. 22, 2007.

* cited by examiner

CONFIGURABLE LED DRIVER/DIMMER FOR SOLID STATE LIGHTING APPLICATIONS

CROSS-REFERENCE TO RELATED APPLICATIONS

This application is a continuation of U.S. patent application Ser. No. 13/059,336, filed Mar. 22, 2011, which is a national stage filing under 35 U.S.C. 371 of International Patent Application PCT/CA2009/001295, filed on Sep. 17, 2009, which claims the benefit of priority of U.S. Provisional Application No. 61/097,963, filed Sep. 18, 2008, each of which are incorporated herein by reference.

BACKGROUND OF THE DISCLOSURE

With the rapid increase in light emitting diode (LED) efficacies for high powered LEDs, the latest technologies have exceeded incandescent and halogen sources and are now starting to compete with fluorescent, mercury vapour, metal halide and sodium lighting. In addition to better energy usage, LEDs also have considerable advantages over traditional light sources such as long life, better durability and improved color generating abilities. The advancement of LED technology by various manufacturers has produced high power LEDs with various recommended drive currents such as 350 mA, 500 mA, 700 mA, 1000 mA, and 1400 mA or higher.

In recent years, controllable power sources for Solid State Lighting (SSL) applications have entered the market with integrated features. In addition, digital controllers within power sources have enabled the development of configurable options to provide a wider flexibility of solutions for Solid State Lighting applications. The ability to dim the light output of LEDs is also important to reduce energy consumption.

However, lighting companies are faced with considerable challenges in adopting SSL technology due to their unfamiliarity and lack of expertise in the driving and dimming requirements for LEDs.

Therefore, there is provided a novel LED Driver/dimmer for solid state lighting applications.

SUMMARY OF THE DISCLOSURE

With the wide variety of communication interface options and LED drive currents available for numerous architectural and entertainment Solid State Lighting applications, the configurable LED Driver/dimmer of the current disclosure includes at least one of the following advantages: configurable output current options that maximize the available power in the "front end" PFC and isolated power conversion converter stage; multiple drive current options for the multiple LED drive current options for various LEDs; elimination of a cooling fan which can present issues with audible noise and flexibility in where the power source is located, relatively low standby power consumption during "black out" lighting conditions, where "black out" refers to no load operation on the output of the dimmer/driver; multiple communication interface options; the ability to map output current sources/channels to different DMX512A addresses and the ability to configure multiple groups of output current sources/channels such that each group is controlled by one 0-10 Vdc analog signal.

Some embodiments of the present disclosure are directed to a highly efficient enclosed, configurable power source, controllable by various external communication interfaces and a method for driving and dimming LEDs or OLEDs in lighting fixtures such as used for architectural or entertainment lighting applications. Such applications can include, but are not limited to, theater, convention centers, cruise ships, architectural building features, amusement parks, museums, and hospitality lighting in restaurants and bars.

In one aspect of the present disclosure, there is provided a configurable light emitting diode (LED) driver/dimmer for controlling a set of light fixture loads comprising: a power circuit; a primary digital controller for controlling the power circuit; a set of output current drivers, each of the set of output current drivers connected to one of the set of light fixture loads for controlling the associated light fixture load; a secondary digital controller for controlling the set of output current drivers; wherein the secondary controller transmits LED control information to control outputs of the set of output current drivers; and wherein the secondary digital controller provides digital feedback control information to the primary digital controller.

In another aspect of the present disclosure, there is provided a configurable power source that provides a plurality of output channels, such as 6, 8, 9, or 12, to color change or dim OLED or LED loads. In color changing applications, the number of available channels is a multiple of three or four to accommodate either red/green/blue LED loads or red/green/blue/amber or white LED loads. The number of output channels and available output power is increased or maximized based on the LED current requirements. The output channels are programmable by means of in circuit serial programming (ICSP) ports and calibrated by a secondary digital controller to the required output current and other parameters such as dimming frequency range.

In another embodiment, the dimming of multiple monochromatic color or white LED loads (output channels) utilizing a single 0-10 Vdc analog control signal, or the control of groups of LED loads (output channels) with an associated 0-10 Vdc analog control signal for each group is contemplated.

In another aspect of the present disclosure, the output channels are digitally controlled current sources configurable for various peak currents to power and control a variety of LEDs. The LED average current is encoded within the three variables of on-time, off-time, and period whereby no three variables are held constant. Depending on the output drive currents of the LED loads, the number of available output channels is maximized based on the maximum output power available from the power factor and isolated DC/DC converter stages.

In another aspect of the present disclosure, the configurable power source is housed in a rectangular enclosure with a monolithic aluminum extrusion and a U shaped aluminum chassis and metal end plates. Various electrical components are thermally coupled to the heatsink to increase or maximize heat transfer to the outside surface of the enclosure.

In another aspect of the present disclosure, the power source includes a digital controller to decrease power consumption of a relay coil as part of an inrush current limit circuit to reduce power consumption and improve efficiency.

In another aspect of the present disclosure, the power source utilizes an independent efficient auxiliary power source and one or more digital controllers to provide power to the communication interface. A digital controller disables various electrical circuits during black out lighting conditions to reduce no load power consumption and improve efficiency.

BRIEF DESCRIPTION OF DRAWINGS

Embodiments of the present disclosure will now be described, by way of example only, with reference to the attached Figures, wherein.

DETAILED DESCRIPTION OF PREFERRED EMBODIMENT

In general, the present disclosure is directed at a method and apparatus for providing a configurable LED Driver/dimmer. In the current description, the Driver/dimmer will be referred to as a dimmer, however, it will be understood that the configurable apparatus can function as either a driver, a dimmer or both. In the preferred embodiment, the dimmer is used for Solid State Lighting (SSL) applications.

Figure 1:
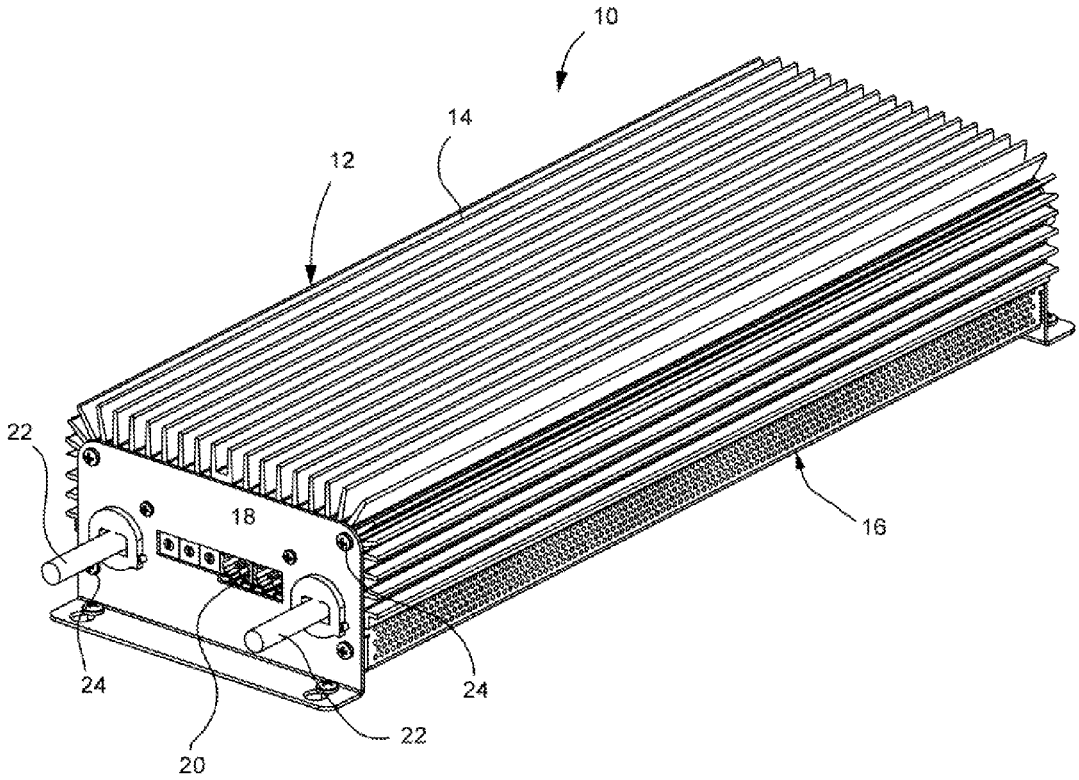
FIG. 1 is a perspective view of a configurable LED Driver/dimmer.

Turning to FIG. 1, a perspective view of an LED dimmer is shown. The LED dimmer 10 includes a body portion 12, or housing, which includes a monolithic aluminum heatsink 14 and a U-shaped chassis 16. Cross-sectional views of the dimmer 10 are provided in FIGS. 2*a* and 2*b*.

The dimmer 10 further includes a front plate 18 which includes a plurality of ports 20 along with a set of conductor cables 22. The front plate 18 is fastened to the body portion 12 via a set of fasteners 24, such as screws. In this embodiment, as conductor cables are used to provide output power to LED/OLED loads, the space requirement for the front plate 18 is reduced with respect to other known connection means such as terminal blocks.

Figure 2A:
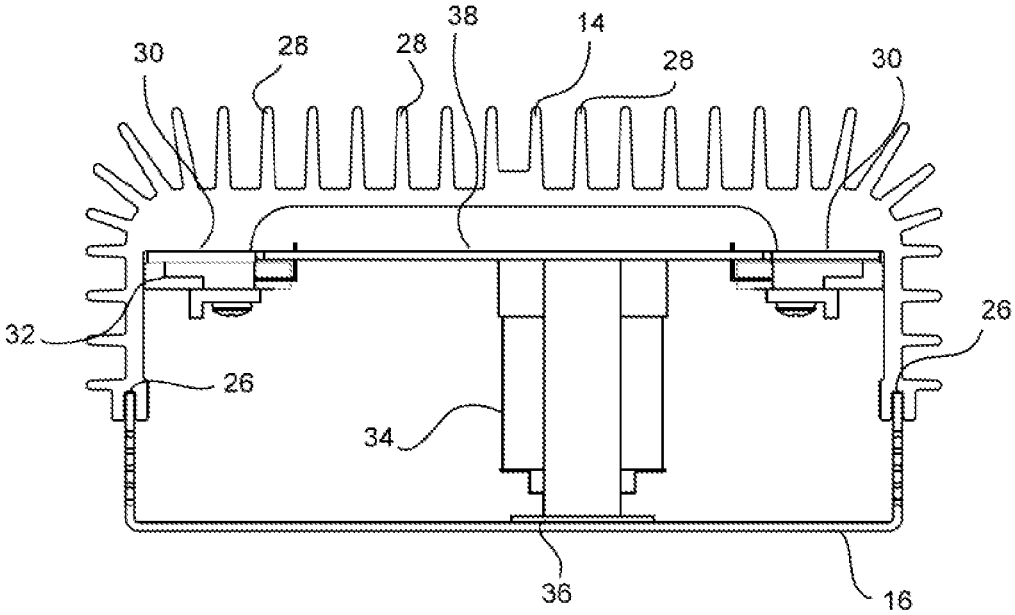
FIGS. 2*a* and 2*b* are cross-sectional views of the configurable LED Driver/dimmer.
Figure 2B:
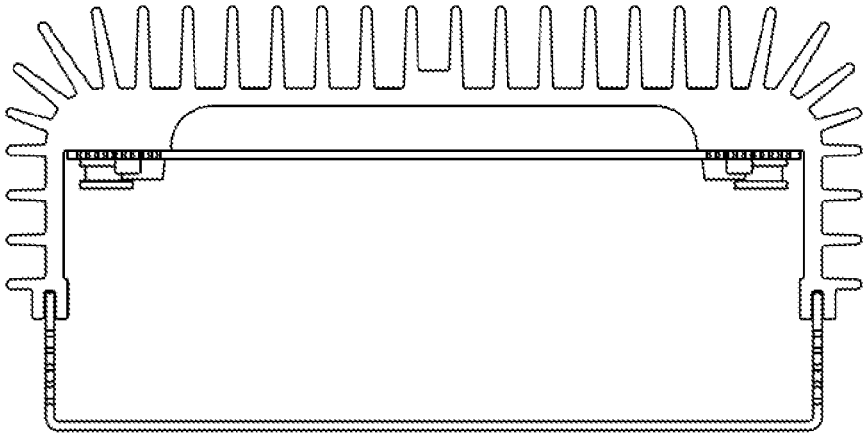
Figure 2C:
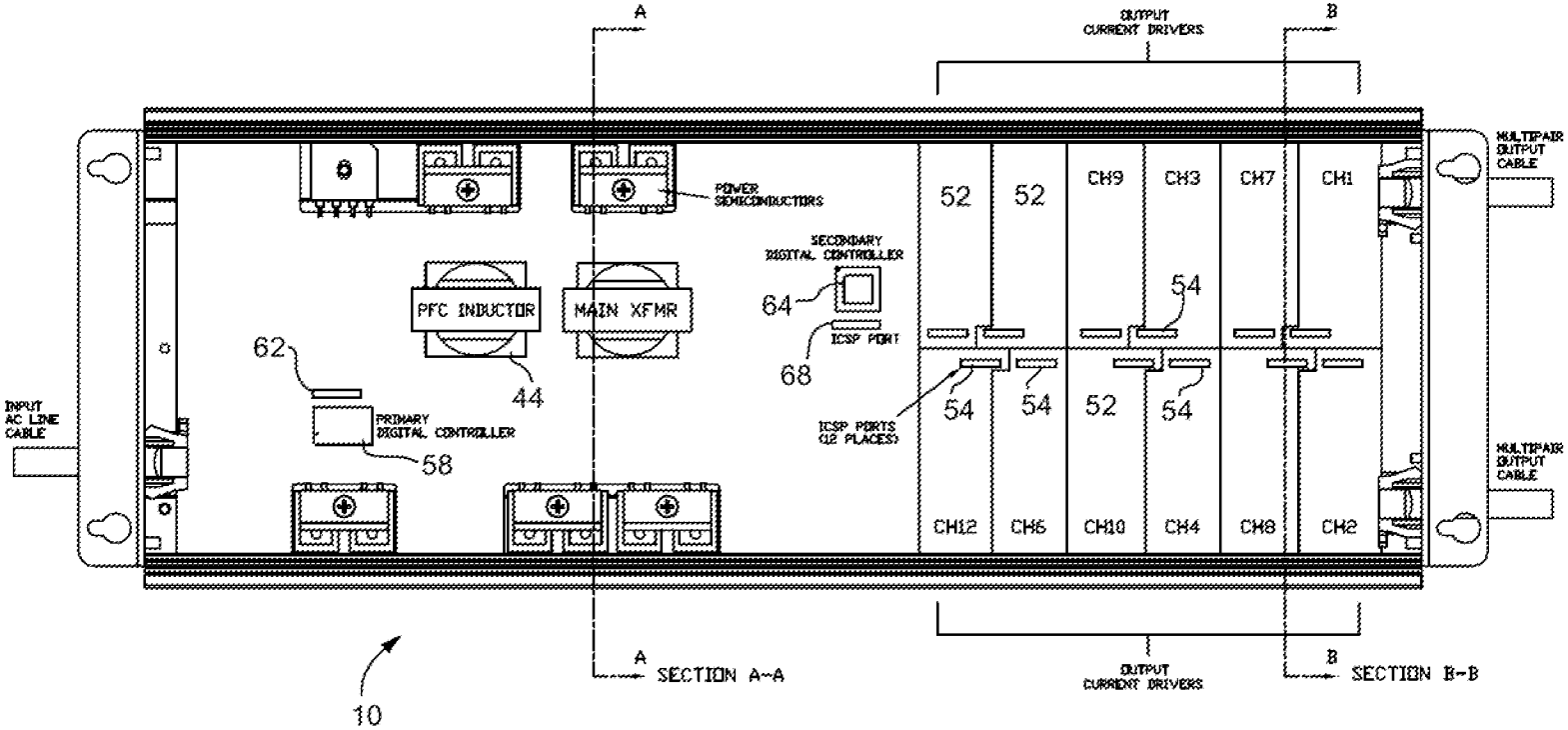
FIG. 2*c* is a schematic view of an internal layout of the LED Driver/dimmer.

Turning to FIGS. 2*a* and 2*b*, a pair of cross-sectional views of the LED dimmer are provided. FIG. 2*c* is a schematic view of one embodiment of an internal layout of the dimmer 10. The cross-sectional views for FIGS. 2*a* and 2*b* are taken along lines A-A and B-B of FIG. 2*c* respectively.

As shown, the heatsink 14 includes a receptacle portion 26 for receiving the ends of the chassis 16. In order to increase, or optimize, the heat dissipation capability of the configurable dimmer 10 at full output power, the extruded aluminum heatsink 14 includes fins 28 to increase the surface area for heat dissipation. The heatsink 14 also has a mounting platform 30 for receiving power components, or semiconductors 32, such as a bridge rectifier, MOSFETs, and/or diodes to efficiently transfer heat to the outside surface of the heatsink 14. These components will be discussed in more detail below with respect to FIG. 3. A power factor inductor and main isolation transformer pair 34 are thermally coupled to the chassis 16 by a thermally conductive, electrically isolated material 36 to further improve heat dissipation of these components. A circuit board 38 is also mounted to the heatsink 14.

Figure 3:
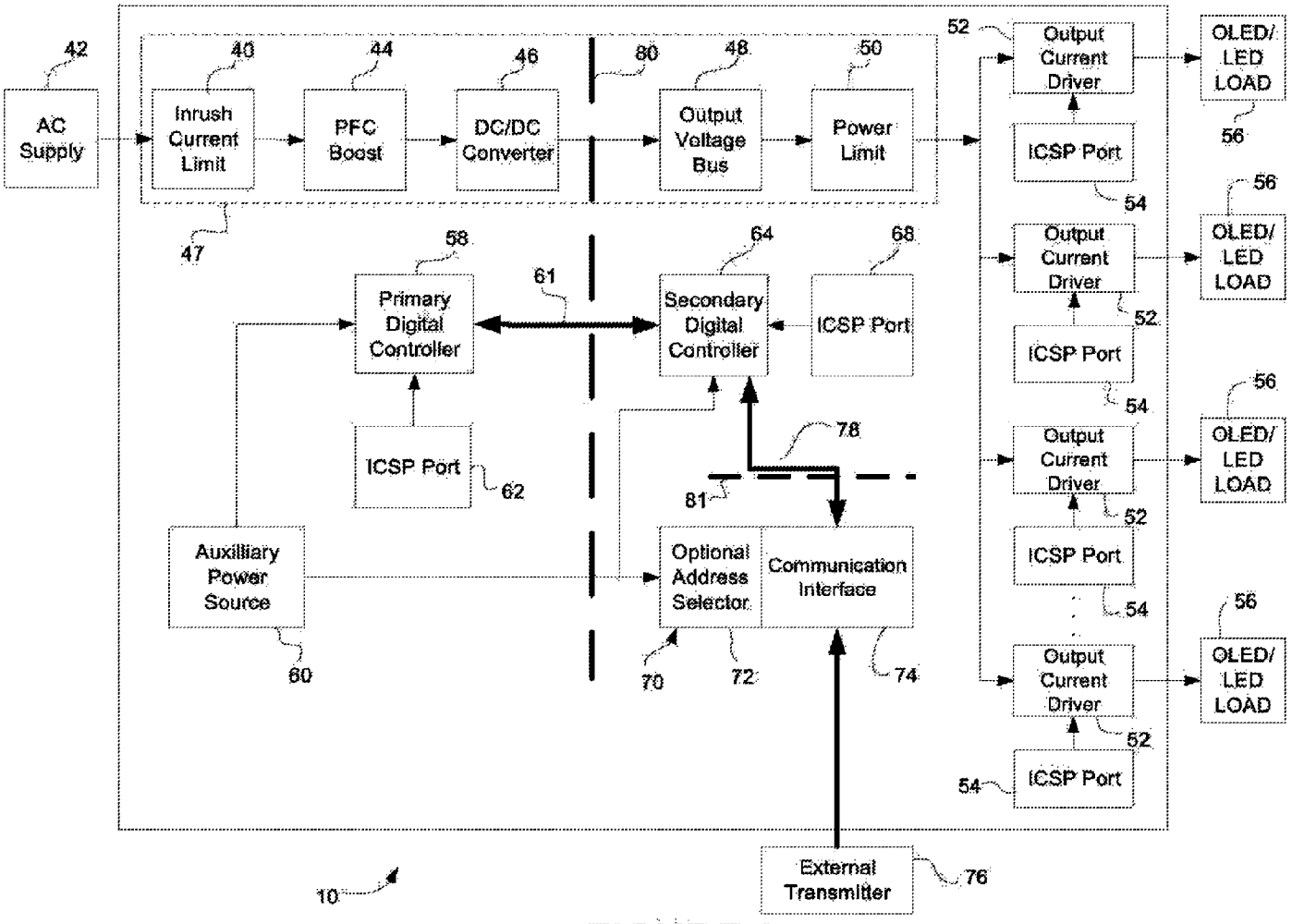
FIG. 3 is a schematic block diagram of the configurable LED Driver/dimmer.

Turning to FIG. 3, a block diagram of another embodiment of the LED dimmer is shown. The LED dimmer 10 includes an inrush current limit 40, or inrush current limit circuit, which receives power from an AC power source or supply 42, located external to the dimmer 10. The inrush circuit 40 is connected to a Power Factor Correction (PFC) Boost 44 which, in turn, is connected to a DC/DC Converter 46, or power conversion stage. The converter 46 is connected to an Output Voltage bus 48 which is connected to a power limiter 50. The inrush circuit 40, the PFC boost 44, the DC/DC converter 46, the Output Voltage Base bus 48 and the power limit 50 can be seen as a power circuit 47. Although only one power limit 50 is shown, it will be understood that there could be multiple power limits. The power limiter 50 is connected to a set of output current drivers 52, whereby each of the output current drivers 52 has an associated in-circuit serial programming (ICSP) port 54. The output of the output current drivers 52 is connected to individual Organic Light-Emitting Diodes (OLED)/Light-Emitting Diodes (LED) loads 56, further referred to as LED loads.

Along with the above-identified components and circuitry, the dimmer 10 further includes a primary digital controller 58 which is connected to an auxiliary power source 60 and an ICSP Port 62. The primary digital controller 58 is further connected, via an isolated communication bus 61 to a secondary digital controller 64, which receives power from the auxiliary power source 60. An ICSP port 68 is also connected to the secondary digital controller 64.

The auxiliary power source 60 is also used to power an interface component 70 which includes an optional address selector 72 and a communication interface 74. The communication interface 74 receives inputs from an external transmitter 76 and communicates via an isolated serial communication bus 78 with the secondary digital controller 64. A set of isolation barriers 80 and 81 are located within the dimmer 10, each barrier separating various components of the dimmer 10 from each other.

As will be understood, not all of the components or connections of the LED dimmer 10 required for operation are shown as they will be understood by one skilled in the art. For instance, the dimmer 10 can also include an EMI filter and a bridge rectifier. With respect to connections, it will be understood that the primary digital controller 58 can also be connected to the PFC boost 44, the inrush current limit 40 and the DC/DC converter 46 while the secondary digital controller 64 can be connected to the output voltage bus 48, the power limit 50 and the output current drivers 52.

In operation, the PFC Boost 44 and DC/DC Converter 46 are controlled by the primary side digital controller 58 while the secondary digital controller 64 monitors the output voltage bus 48 and provides digital feedback control information via isolated communication bus 61 to regulate the output voltage bus 48. Secondary digital controller 64 also translates dimming and/or color mixing information from the external transmitter 76 into LED control information for the output current drivers 52. The primary 58 and secondary 64 digital controllers and output current drivers 52 have an associated programming port for further configuring the LED dimmer 10.

Figure 4:
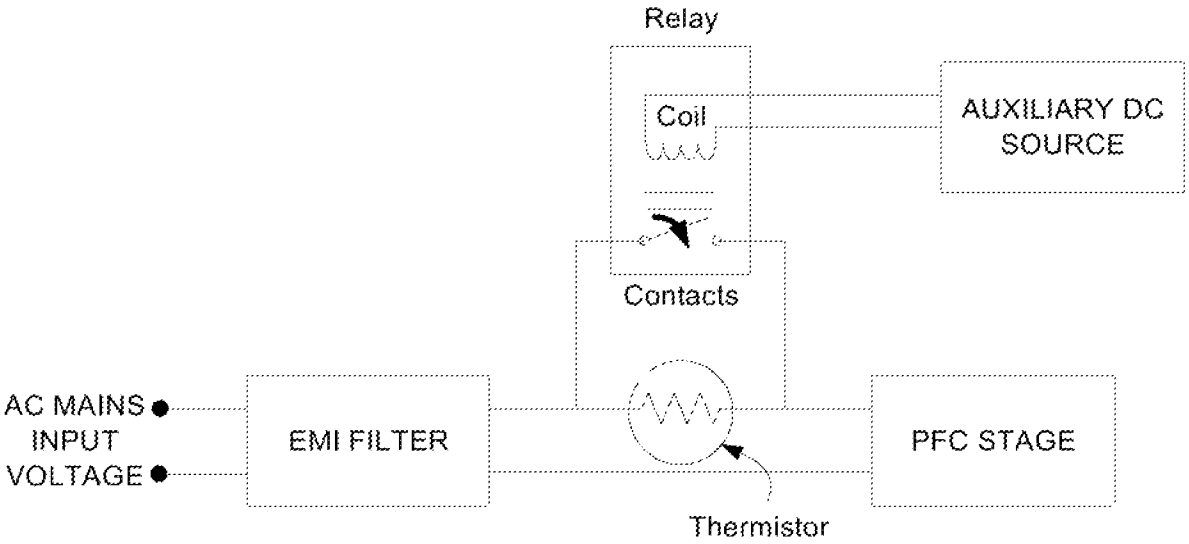
FIGURE 4 (PRIOR ART)
FIG. 4 is a schematic diagram of a prior art inrush current limit circuit.

Turning to FIG. 4, a prior art inrush current limit is shown. In order to limit inrush current limit during initial start up of the power source, one approach is to utilize a negative temperature coefficient thermistor (NTC) in parallel with a relay contact. During initial turn on of the power source, the NTC thermistor limits the inrush current. When the PFC boost stage bulk capacitor is charged, and before the PFC stage is enabled by the primary controller, the primary controller closes the relay contact to bypass the NTC thermistor. This is accomplished by applying a DC voltage via a switch across the coil in the relay.

A limitation of this approach is the power consumption of the relay coil when a continuous DC voltage is applied. This power consumption becomes significant in terms of Energy Star requirements during no load or standby operation such as when a "black out" or minimum light intensity state is received by the communication interface.

Figure 5:
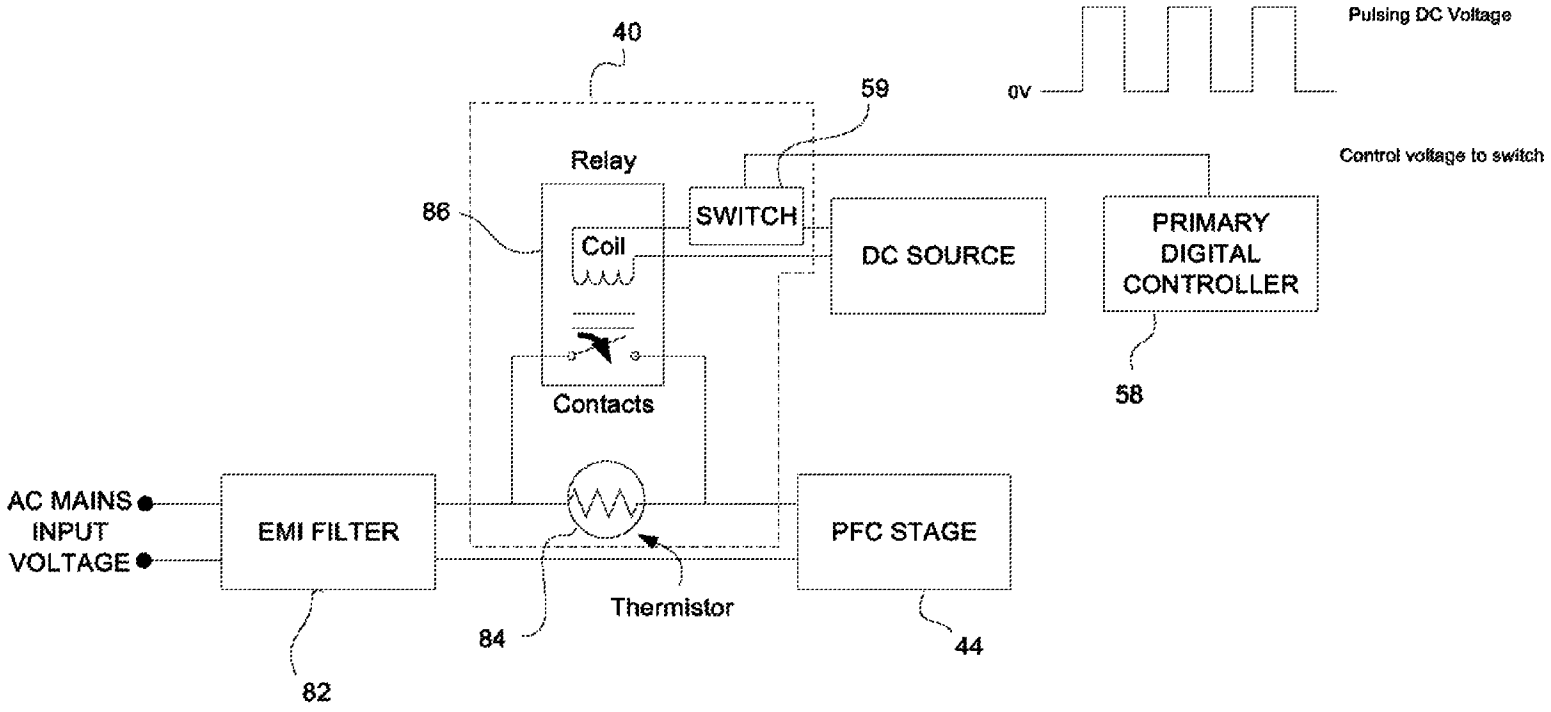
FIG. 5 is a schematic diagram of an embodiment of a novel inrush current limit circuit for use with the configurable LED Driver/dimmer.

Turning to FIG. 5, an embodiment of an improved inrush current limit 40 is shown. An EMI filter 82 is connected between the power supply and the current limit 40 and is connected directly to the PFC boost 44 and via the current limit 40. The current limit 40 includes a thermistor 84, a relay or relay contact 86 and a switch 59. The relay contact 86 is connected in parallel with the thermistor 84. A typical relay coil requires greater energy to close the contacts than is required with the currently described limiter 40 to maintain the contacts in a closed position since less holding force is required. After the relay contacts have been closed by applying a voltage of 12 Vdc, modulation of the relay coil voltage can be initiated by the primary controller 58 to effectively reduce the average voltage across the coil to approximately 5 volts versus a DC voltage of 12V, reducing power consumption. It should be noted that the pulse duty cycle and frequency can also be changed to improve or optimize performance.

In one embodiment, the primary controller 58 pulses the DC voltage across the relay coil via the switch 59 to reduce power consumption.

In one embodiment, for the PFC boost 44, as shown in FIG. 3, the PFC Boost 44 utilizes a boost topology with an input AC voltage mains range of 103 Vac to 300 Vac from the AC supply 42. Energy stored in an inductor within the PFC boost 44 is transferred and stored in the bulk capacitor on a cycle by cycle switching basis at a loosely regulated 430V DC over the input range. The energy is controlled in a manner that forces AC input current to be sinusoidal and in phase with the AC line voltage. By drawing current in phase with the input mains voltage 42, the amount of harmonic currents of the fundamental AC mains frequency being introduced into the power line is reduced.

For the DC/DC convertor 46 and the output voltage bus 48, the preferred embodiment for the DC/DC converter 46 is derived from the isolated buck converter topology and comprises a galvanically isolated full bridge converter employing a primary side phase modulation technique with a secondary side current doubler rectifier circuit.

The full bridge converter parasitic circuit elements in conjunction with primary magnetization current and reflected inductor ripple current cause resonant edge switching transitions on the MOSFET switch thus forcing zero voltage across the MOSFET switching device before turn on. The result is higher efficiency due to the elimination of Coss (drain to source MOSFET Capacitance) switching losses, reduction of gate charge across the Miller capacitance and minimized power loss during switching transitions when voltage and current are changing simultaneously.

Since the output of the DC/DC converter is a tightly regulated DC bus 48, the set of power limit circuits 50 are coupled to either one or more current drivers 52 to limit the power output of each of the output current drivers. 52 The power limit circuits 50 each include a current sensor that is monitored by the secondary controller 64. In the event of a single component failure within the output current driver module, the power limit circuits 50 limit the energy to the loads in accordance with the UL standard 1310 Class 2. Supplementary protection to the power limit circuits can also include one or more fuses.

For the primary digital controller 44, the controller 44 provides digital feedback control for the PFC Boost 44 and DC/DC Converter 46. The digital feedback method for the PFC Boost 44 utilizes average current mode control with duty cycle feed forward for the inner current loop and voltage mode control for the outer control loop. The DC/DC Converter 46 utilizes voltage mode control for the digital control loop.

The primary digital controller 44 also controls the inrush current limit circuit 40, provides primary current limit protection, and over voltage protection for the output of the PFC Boost 44. The primary digital controller 44 also disables the PFC Boost 44 and the DC/DC Converter 46 during black out or no load conditions to reduce power dissipation.

With respect to the output current drivers 52, configuring the required number of outputs and required output current is accomplished by populating the appropriate sections of a single printed circuit board with the appropriate electrical components and programming the output current driver via the in-circuit serial programming (ICSP) ports 54.

Figure 6:
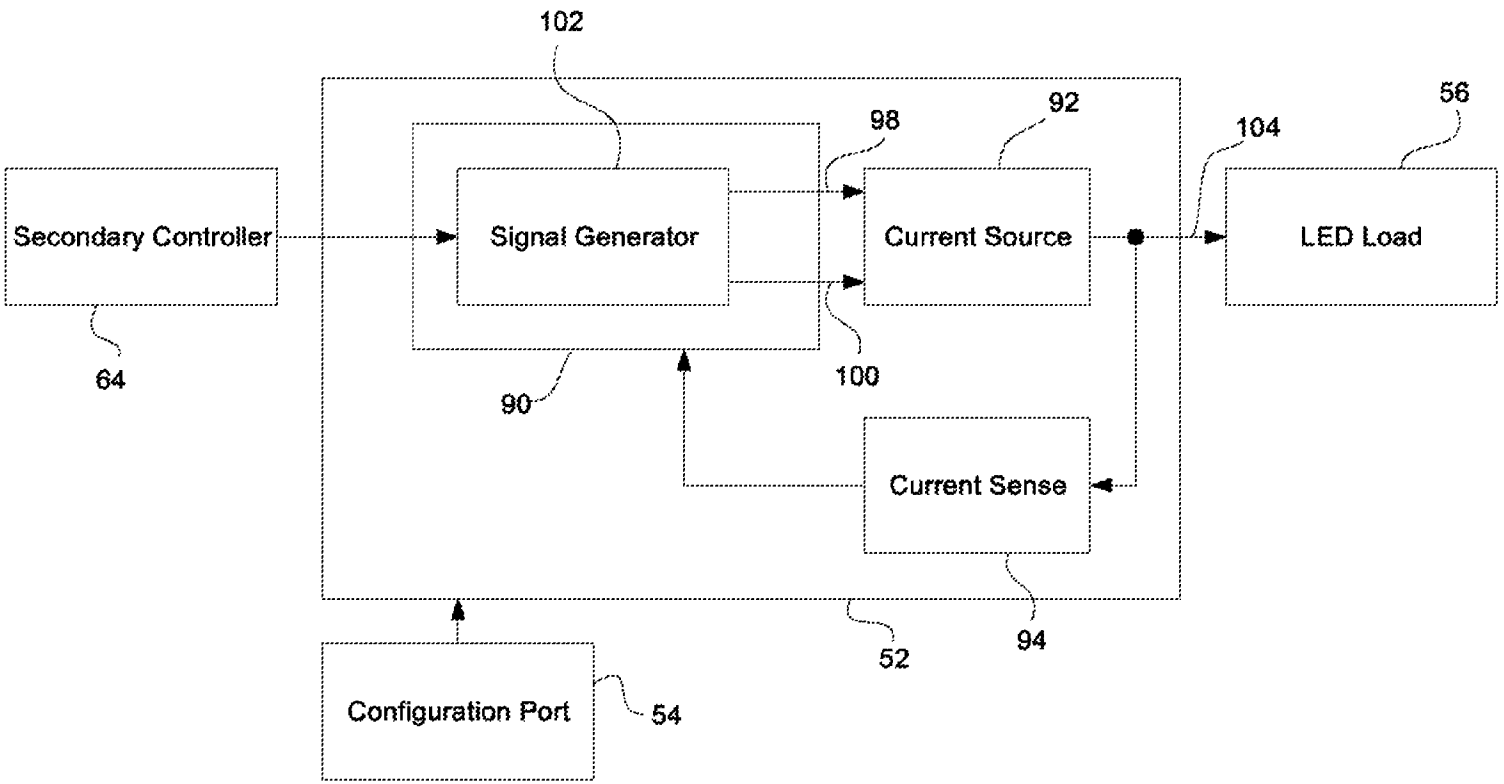
FIG. 6 is a schematic diagram of an embodiment of an output current driver.

Turning to FIG. 6, which is an embodiment of an output current driver, the output current driver 52 comprises a load controller 90, a current source 92, and current sense 94. Although only one current driver 52 is shown, it will be understood that multiple are present as reflected in FIG. 3.

The output current driver utilizes the dimming/color mixing techniques for LEDs described in detail in US Patent Publication No. 2007/0103086, which is hereby incorporated by reference, wherein the LED average current is encoded within the three variables of on time, off time, and period where by no three variables are held constant.

The secondary controller 64 receives dimming or color mixing information in the form of a serial data stream from the external transmitter 76 via the communication interface 74 and then translates the data stream into LED control information. The LED control information is transmitted to the load controller 90 in the form of instructions to generate a digital signal 98 and an analog signal 100.

The load controller 90 further comprises a signal generator 102 which transmits the digital signal 98 and the analog signal 100 to the current source 92. The digital control signal 98 and the analog signal 100 are preferably generated via a digital control algorithm and 1 Bit algorithm, respectively.

The current source 92 preferably includes ancillary circuitry for operation and comprises a buck topology power stage with hysteretic control. The current sense 94 provides a digital feedback loop for each current source 92. In the preferred embodiment, the current source 92 is a buck circuit topology however other embodiments can include topologies such as boost, buck-boost, or single ended primary inductor converter (SEPIC).

Output 104 of the current driver 52 provides a current pulse via current source 92 to the LED Load 56 whereby on times, off times, and period are not held constant.

Each output current driver 52, has an associated in-circuit serial programming (ICSP) port 54. The ICSP port 54 provides access to the load controller 90 such that firmware updates are possible to permit the configuration of the output current drivers 52. The ICSP port(s) 54 for the output current driver(s) 52 can be located on the printed circuit board assembly of the apparatus or they can be located on the outside of the enclosure.

The configuration options include, but are not limited to, such parameters as the adjustment of the frequency range of the dimming current pulse for the range of light intensity output or the set point adjustment of the peak on time output current.

For example, it might be necessary to increase the frequency range of the dimming current pulse in video recording applications where the dimming current pulse frequency can be programmed for a 2000 Hz to 2500 Hz range. This would negate a visible beat frequency effect that would other wise be noticeable on recorded video. There can be other applications where the adjustment of the dimming current frequency range is required to reduce EMI effects.

The default peak output current set point is programmed via the ICSP port 54 which provides flexibility in the number of possible LEDs types that can be driven and is typically dependent on the recommended operating current specified by the manufacturer such as 350 mA, 700 mA, etc. The set point current is preferably programmed to within 4% of the manufacturer's specification. The peak output current set point can then be precisely calibrated to within typically 1% via the secondary controller 64 during factory calibration.

Figure 7:
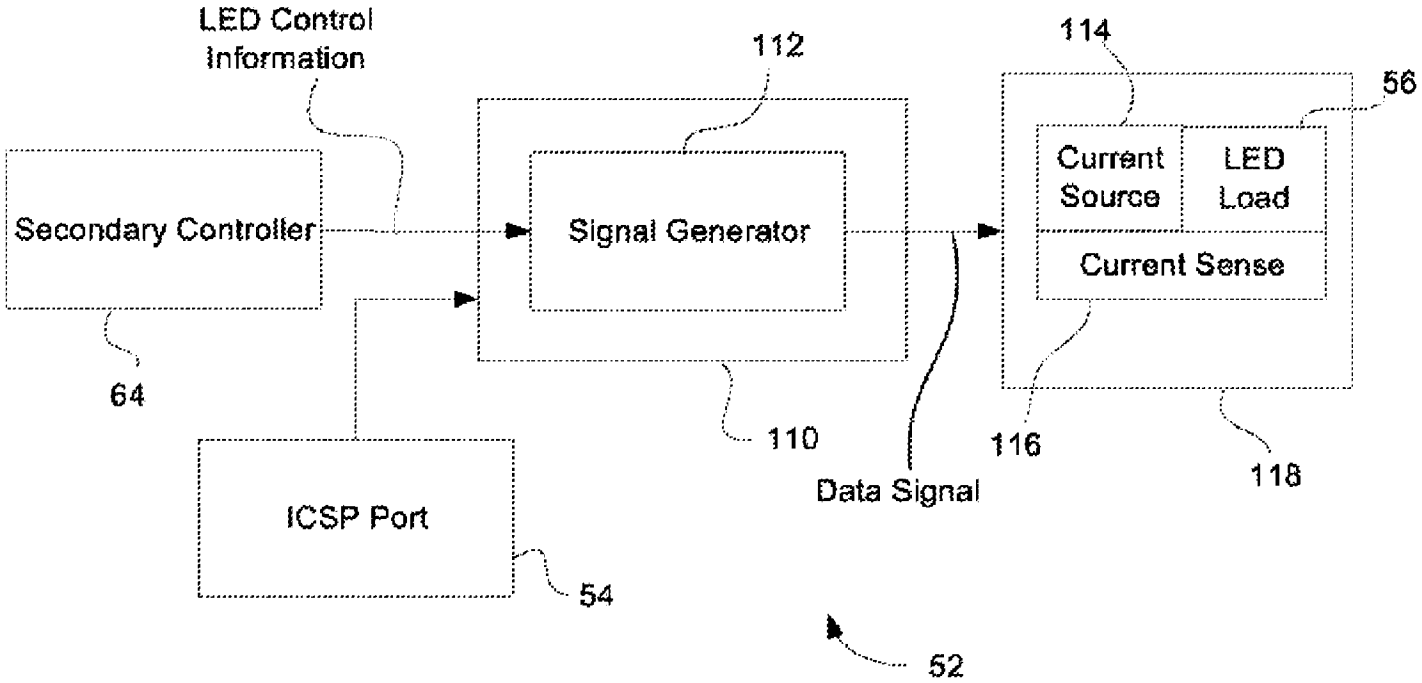
FIG. 7 is a schematic diagram of another embodiment of the output current driver.

An alternate embodiment of an output current driver 52 is shown in FIG. 7. In this embodiment, the output current driver 52 comprises a load controller 110 including a signal generator 112. A current source 114 and a current sense 116 are located within an apparatus 118, such as a light fixture. The light fixture 118 also includes the LED load 56. After receiving the LED control information from the secondary controller 64, the signal generator 112 provides a data signal to the light fixture 118 to operate the LED load 56 via the current source 114 and the current sense 116. This is also schematically shown in FIG. 8.

Figure 8:
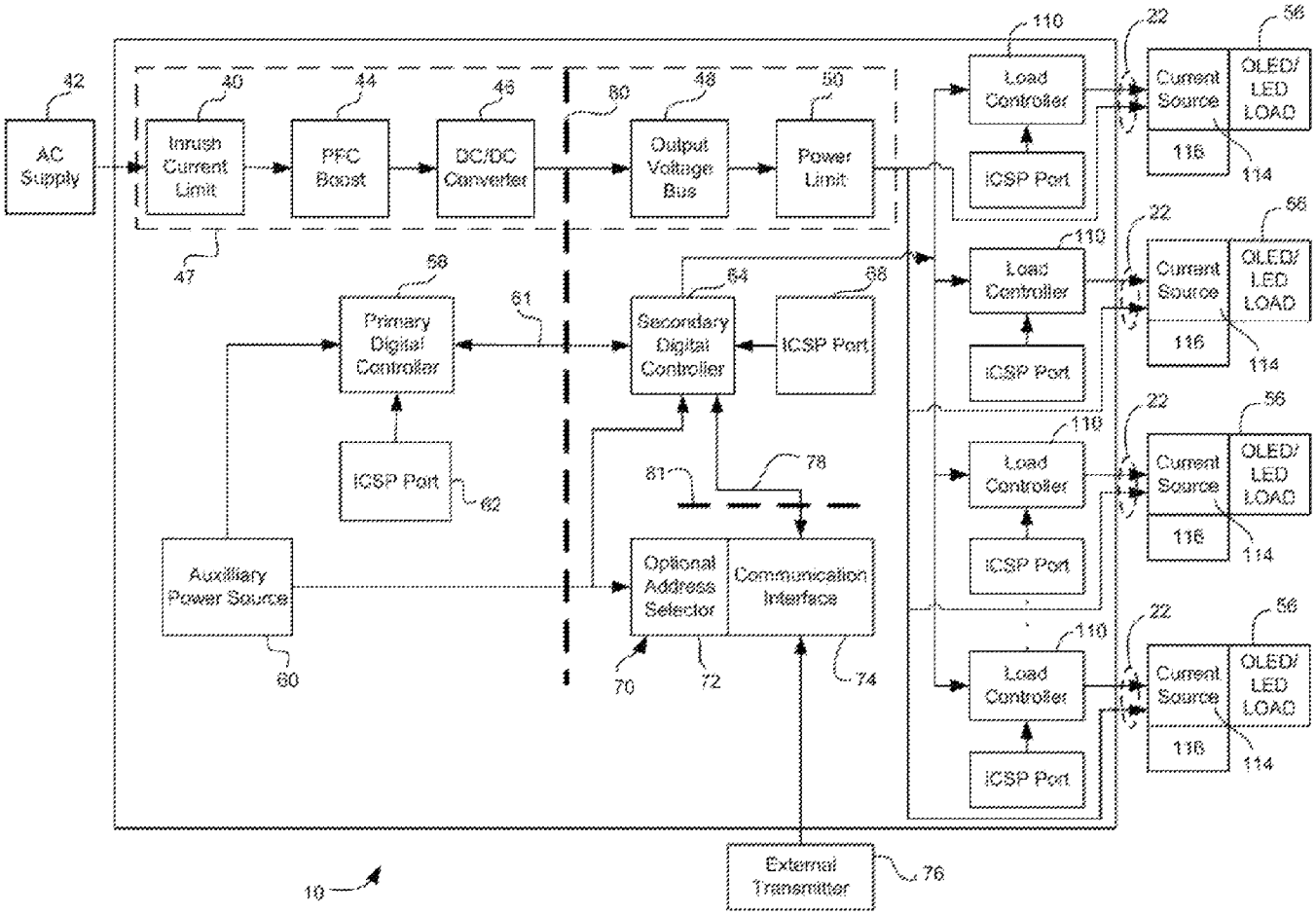
FIG. 8 is a schematic block diagram of another embodiment of the configurable LED Driver/dimmer.

FIG. 8 is a schematic diagram of an alternate embodiment of a configurable LED dimmer 10. As shown, individual current sources 114 and current senses 116 are mounted in the light fixture containing the LED load 56, and power and data signals are provided to each output current source 114 by the multi conductor cable 22. In this embodiment, the current sources 114 are configured to regulate to a predetermined peak current. The load controller 110 transmits the data signal containing the output current information encoded within the three variables of on time, off time, and period whereby no three variables are held constant.

Figure 9:
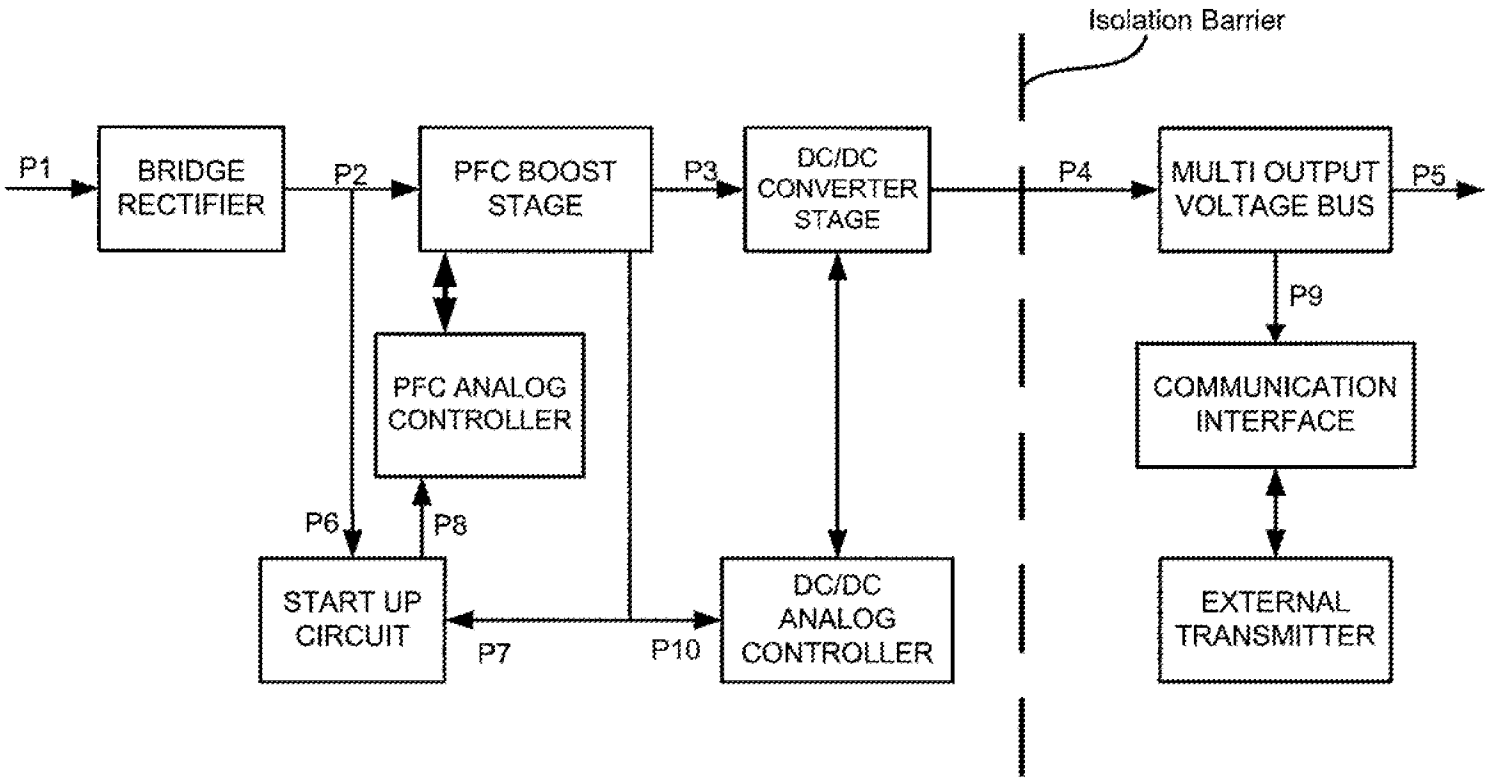
FIGURE 9 (PRIOR ART)
FIG. 9 is a schematic diagram of a prior art multistage power source.

Turning to FIG. 9, a known application of internal auxiliary power requirements in a multistage power source is shown and illustrates how auxiliary power is provided to the various blocks of a multistage power source. P1, P2 . . . P10 represents the various power and voltage transfer requirements for each functional block. For simplicity, the various voltage regulator and filter circuits required for each of the power outputs have been omitted.

In operation, the bridge rectifier converts the AC mains voltage P1 to a rectified voltage P2. A portion of power P6 from the output of the bridge rectifier P2 is supplied to the start up circuit. The start up circuit is comprised of a power transistor or MOSFET and is intended to provide power P8 to the PFC analog controller for only a short duration of a few seconds. Power P8 to the PFC analog controller will allow the PFC Boost stage to begin switching, providing power P10 to the DC/DC controller, and power P3 to the DC/DC converter power stage. Since the start up circuit dissipates an excessive amount of power, it is turned off by the voltage component of P7 supplied by the PFC boost stage. The P7 power is permitted to 'flow through' the start up circuit to continue to supply power P8 to the PFC analog controller.

The output of the DC/DC Analog Converter provides power P4 to the multi output voltage bus, power P9 to the Communication Interface, and the Output Current Drivers by means of P5.

In this implementation, the PFC and DC/DC Controllers are typically analog controllers. It should be noted that in this implementation, in order for the communication interface to continually receive dimming information from an external transmitter, the DC/DC Converter stage must remain turned on. Similarly, in order for the DC/DC converter stage to provide power P4, the PFC Boost stage must remain on.

In a 'black out' state, the communication interface may receive a "0" intensity value out of 255 intensity levels for all of its output current drivers via the external transmitter such as a DMX512A or RDM controller interface, or it may receive an analog voltage of between 0 to 1V via a controller compliant to ESTA E1.3-2001 or IEC60929 as one of many communication interface options. In this 'black out' state, the DC/DC Converter and PFC Boost Stage continue to dissipate an excessive amount of power.

Figure 10:
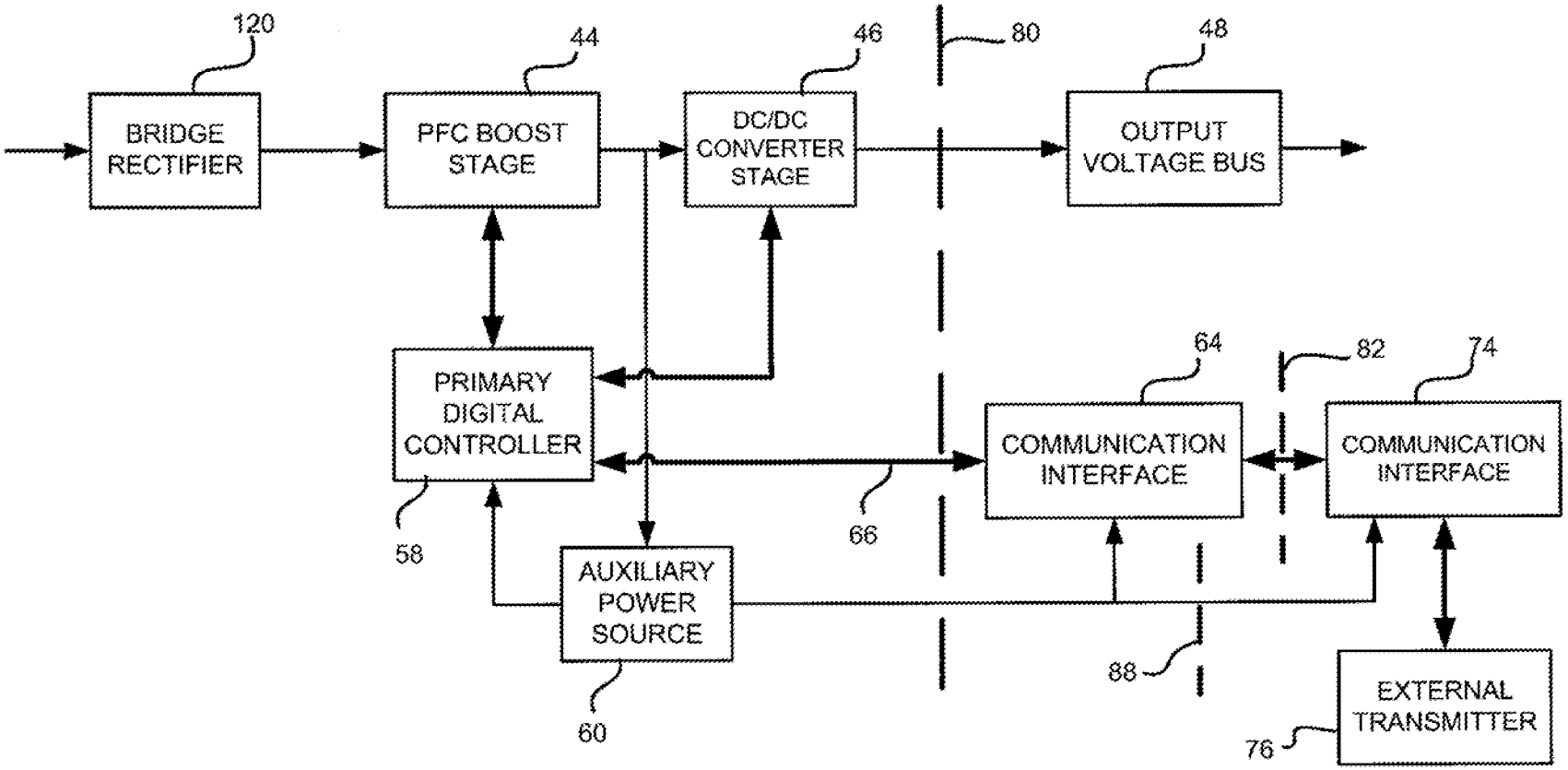
FIG. 10 is a schematic diagram of an embodiment of a novel multistage power source.

FIG. 10 is directed at an embodiment of an improved internal auxiliary power distribution in a multistage power source for providing auxiliary power to the various blocks of a multistage power source. For simplicity, the various voltage regulator and filter circuits required for each of the power outputs have been omitted. The transfer of power from AC mains to the Output Current Drivers (52) is unchanged. This embodiment shows an improved implementation of an independent auxiliary power source providing power to the primary digital controller 58, the secondary digital controller 64, and the communication interface 74. The auxiliary power source 60 comprises an efficient isolated flyback topology with a wide input voltage range and pulse skipping capability to minimize its power dissipation at light loads or no load conditions. In other words power can be provided to the primary digital controller 58, the secondary digital controller 64, and the communication interface 74 via an auxiliary flyback converter.

A 'black out' state received from the external transmitter 76 to the communication interface 74 is communicated to the secondary digital controller 64 and then the primary digital controller 58 via the isolated communication bus 66. The primary digital controller 58 then disables the PFC Boost Stage 44 and DC/DC Converter Stage 46 reducing overall power dissipation of the configurable power source.

It should be noted that even when the PFC Boost 44 is disabled, power can continue to be supplied to the auxiliary power source 60 since rectified voltage from a bridge rectifier 120 can continue to peak charge the PFC boost 44 through an internal capacitor via the boost diode.

The auxiliary power source 60 continues to provide power to the primary digital controller 58, secondary digital controller 64, and communication interface 74 in order to be able to 'listen' for or sense a change in light intensity state that may be communicated by the external transmitter 76.

Alternate embodiments can include additional ancillary circuits that can be powered by the independent auxiliary power source that can be disabled by a controller to reduce over all power dissipation in black out or no load conditions.

With respect to the communication interface 74, the communication interface 74 comprises a removable and interchangeable module with each module adapted for different control options such as DMX512A, RDM, 0-10 Vdc and Zigbee. Operation of the communication interface with such control options will be understood by one skilled in the art.

The communication interface module receives lighting control information via the external transmitter 76 and converts the various protocols into a serial data stream. It then transmits this data by means of a Universal Asynchronous Receiver Transmitter (UART) to the secondary digital controller 64 via the isolated serial communication bus 78. The isolated serial communication bus 78 is comprised of a isolation barrier 82 to "float" the communication interface and prevent ground loops.

Figure 11:
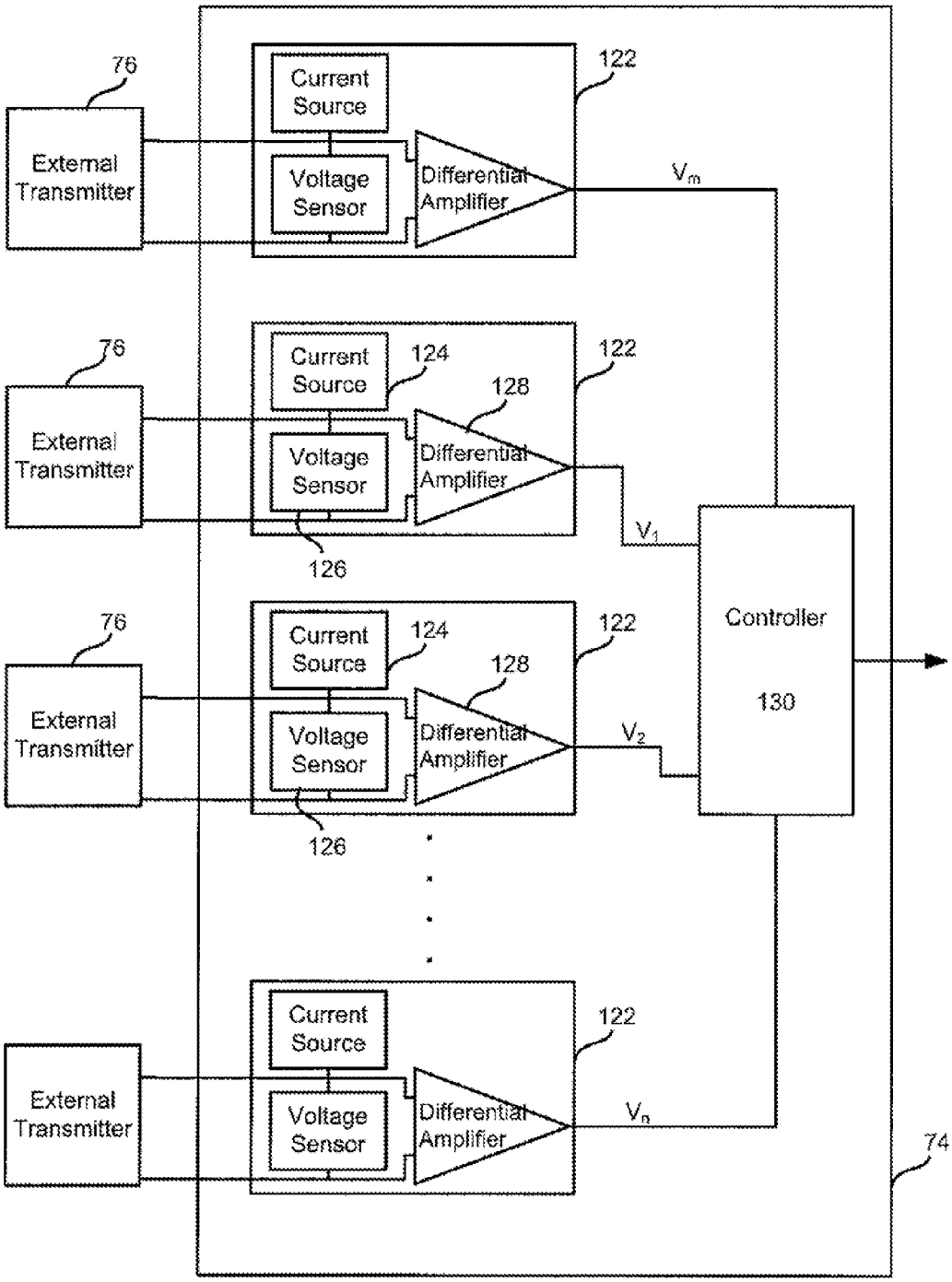
FIG. 11 is a schematic diagram of a communication interface for use with the configurable LED Driver/dimmer.

Turning to FIG. 11, an embodiment of the communication interface is shown. In this embodiment, an analog interface module adapted for 0-10 Vdc IEC60929 or ESTA E1.3-2001 dimming methods as the communication interface 74 is shown. The analog interface module can be adapted to receive one or more analog control voltages from one or more associated external transmitters 76. The external transmitter 76 is preferably an electronic resistor or potentiometer that sinks current from the current source located on the analog interface module and outputs a variable 0-10 Vdc control voltage proportional to the required light intensity.

Individual external transmitters 76 supply signals to various controls 122 within the communication interface 74. Each control 122 is representative of an area or group of LED loads 56. Within each control 122 is a current source 124, a voltage sensor 126 and a differential amplifier 128. The differential amplifier 128 senses a voltage across the voltage sensor 126 and converts this into a correlated voltage (Vm, V1, V2 . . . Vn) supplied to a controller 130. The controller 130 converts this analog voltage into a serial data stream for transmission to the secondary digital controller 64 via the isolated serial communication bus 78.

The communication interface 74 can be configured to have one 0-10 Vdc control voltage simultaneously control via the secondary digital controller 64, all output current drivers 52 and LED loads 56. This application is beneficial in monochromatic color or white lighting applications since only one control signal and associated wiring is required to control multiple light loads.

Furthermore, the communication interface 74 can be adapted to have one or more 0-10Vdc signal voltages control an associated group of one or more output current drivers in zonal dimming applications. An optional master 0-10 Vdc signal voltage could be able to simultaneously control all of the individual groups of output current drivers.

In applications not requiring the complexity of DMX512A, these analog control options are beneficial in red/green/blue or red/green/blue/amber color changing or monochromatic color or white light applications whereby the addressability and corresponding control of individual LED light loads is not required.

With respect to the secondary digital controller 64, the controller 64 monitors and transmits digital output voltage bus information (feedback loop) via the two way isolated serial communication bus 78, decodes the serial data from the communication interface 74, and transmits control information to the output current drivers 52. As a protection feature, the secondary controller 64 also monitors output currents from the power limit stages 50 supplied to the output current drivers 52

The secondary digital controller 64 includes the ICSP port 68 to program and calibrate the output voltage bus 48 to the required voltage. In DMX512A applications, the ICSP port 68 also allows for the mapping of each of the output channels to a wide variety of addresses. Similarly, in 0-10 Vdc analog control applications, the secondary digital controller ICSP port allows for the mapping of output channels into groups for each associated 0-10Vdc control signal.

This mapping capability is particularly useful in addressable-networked lighting systems using a DMX512A control protocol where different lighting zones are required to respond to different illumination information. For example, in a 12 channel output configuration, the first 6 channels could be mapped to the DMX base address of the power source (ie DMX01) and the last 6 channels could be mapped to DMX address +1 (i.e. DMX02).

This mapping capability is also useful in zone dimming applications using 0-10 Vdc analog controls as the communication interface. For example, a 12 channel output LED dimmer configuration can have 7 output channels grouped for a first associated 0-10 Vdc signal, the next 3 channels can be grouped to a second associated 0-10 Vdc control signal, and the last 2 channels can be grouped to a third associated control signal.

Embodiments of the disclosure can be represented as a software product stored in a machine-readable medium (also referred to as a computer-readable medium, a processor-readable medium, or a computer usable medium having a computer-readable program code embodied therein). The machine-readable medium can be any suitable tangible medium, including magnetic, optical, or electrical storage medium including a diskette, compact disk read only memory (CD-ROM), memory device (volatile or non-volatile), or similar storage mechanism. The machine-readable medium can contain various sets of instructions, code sequences, configuration information, or other data, which, when executed, cause a processor to perform steps in a method according to an embodiment of the disclosure. Those of ordinary skill in the art will appreciate that other instructions and operations necessary to implement the described disclosure can also be stored on the machine-readable medium. Software running from the machine-readable medium can interface with circuitry to perform the described tasks.

The above-described embodiments of the disclosure are intended to be examples only. Alterations, modifications and variations can be effected to the particular embodiments by those of skill in the art without departing from the scope of the disclosure, which is defined solely by the claims appended hereto.

What is claimed is:

1. A configurable light emitting diode (LED) driver for powering a set of light fixture loads comprising:

a power circuit including: an inrush current limit; a DC/DC converter;

a power factor correction (PFC) boost connected to the inrush current limit and the DC/DC converter;

a regulated output voltage bus connected to the DC/DC converter;

a primary controller for controlling the power circuit;

a set of output current drivers, each of the set of output current drivers connected to one of the set of light fixture loads for powering the associated light fixture load, and;

an apparatus for configuring the set of output current drivers to an output current set point.

2. The LED driver of claim 1 wherein the apparatus for configuring comprises at least one port associated with at least one of the set of output current drivers for configuration of the output current drivers.

3. The LED driver of claim 2 wherein the port is at least one in-circuit serial programming (ICSP) port.

4. The LED driver of claim 2 wherein the at least one port is connected to the set of output current drivers.

5. The LED driver of claim 2 wherein the apparatus for configuring programs the output current set point.

6. The LED driver of claim 1 wherein the apparatus for configuring is integrated with a secondary controller.

7. The LED driver of claim 6 wherein the apparatus for configuring calibrates the current set point.

8. The LED driver of claim 6 further comprising a communication interface for receiving data from an external transmitter.

9. The LED driver of claim 8 wherein the communication interface is either DMX512A, 0-10Vdc analog control, Zigbee wireless or Remote Device Management (RDM) compatible.

10. The LED driver of claim 8 comprising a means to map output current drivers to various dimming zones for DMX512A control.

11. The LED driver of claim 8 comprising a means to map output current drivers to various dimming zones for 0-10 Vdc control.

12. The LED driver of claim 8 comprising an auxiliary flyback converter to provide power to the primary controller, secondary controller and communication interface.

13. The LED driver of claim 6 wherein the primary and secondary controllers are digital controllers.

14. The LED driver of claim 13 wherein the primary digital controller can disable the PFC boost and DC/DC Converter at zero light intensity state.

15. The LED driver of claim 1 wherein the output voltage bus is connected to at least one power limit.

16. The LED driver of claim 1 wherein the set of output current drivers comprise a buck topology power converter.

17. The LED driver of claim 1 further comprising a housing portion for housing the components of the driver.

18. The LED driver of claim 17 wherein the apparatus for configuring is integrated with the housing portion.

19. The LED driver of claim 1 wherein the light fixture load is one of an Organic LED (OLED) load or an LED load.

20. A configurable light emitting diode (LED) driver for powering a set of light fixture loads comprising:

a power circuit including:

an inrush current limit;

a DC/DC converter;

a power factor correction (PFC) boost connected to the inrush current limit and the DC/DC converter;

a regulated output voltage bus connected to the DC/DC converter; and at least one power limit connected to the regulated output voltage bus; and a set of output current drivers, each of the set of output current drivers connected to one of the set of light fixture loads for powering the associated light fixture load.

21. The LED driver of claim 20 wherein the at least one power limit comprises a current sensor.

22. The LED driver of claim 21 wherein the current sensor is monitored by a controller.

23. The LED driver of claim 22 wherein the controller includes an apparatus for configuring the regulated output voltage bus to a calibrated voltage.

24. The LED driver of claim 20 wherein the regulated output voltage bus and at least one power limit are enclosed within a housing.

25. The LED driver of claim 24 wherein the housing comprises a heatsink with fins.

* * * * *